US007298332B2

(12) United States Patent
Ryken, Jr. et al.

(10) Patent No.: US 7,298,332 B2
(45) Date of Patent: Nov. 20, 2007

(54) FOURTEEN INCH X-BAND ANTENNA

(75) Inventors: Marvin L. Ryken, Jr., Oxnard, CA (US); Albert F. Davis, Ventura, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 191 days.

(21) Appl. No.: 11/288,056

(22) Filed: Nov. 17, 2005

(65) Prior Publication Data

US 2006/0250306 A1 Nov. 9, 2006

Related U.S. Application Data

(63) Continuation-in-part of application No. 11/145,234, filed on Jun. 1, 2005, now Pat. No. 7,109,929, which is a continuation-in-part of application No. 10/817,412, filed on Mar. 31, 2004, now Pat. No. 7,009,564, which is a continuation-in-part of application No. 10/664,614, filed on Sep. 19, 2003, now Pat. No. 6,856,290.

(51) Int. Cl.
*H01Q 1/38* (2006.01)

(52) U.S. Cl. ..... 343/700 MS

(58) Field of Classification Search ..... 343/700 MS, 343/770, 846, 853
See application file for complete search history.

(56) References Cited

U.S. PATENT DOCUMENTS 5,061,943 A * 10/1991 Rammos ..... 343/770
5,650,788 A * 7/1997 Jha ..... 343/700 MS
5,995,062 A * 11/1999 Denney et al. ..... 343/853
6,239,762 B1 * 5/2001 Lier ..... 343/770
6,366,244 B1 * 4/2002 Fernandes ..... 343/700 MS

* cited by examiner

*Primary Examiner*—Huedung Mancuso
(74) *Attorney, Agent, or Firm*—David S. Kalmbaugh

(57) ABSTRACT

An X-Band microstrip antenna for use on a fourteen inch diameter projectile to transmit telemetry data. The X-Band microstrip antenna is configured to wrap around the projectile's body without interfering with the aerodynamic design of the projectile. The X-Band microstrip antenna operates at 7900 to 8100 MHz telemetry frequency band. Sixteen microstrip antenna elements equally spaced around the projectile provide for linear polarization and a quasi-omni directional radiation pattern.

17 Claims, 3 Drawing Sheets

FOURTEEN INCH X-BAND ANTENNA

This application is a continuation-in-part of U.S. patent application Ser. No. 11/145,234, filed Jun. 1, 2005, now U.S. Pat. No. 7,109,929, which is a continuation in part of U.S. patent application Ser. No. 10/817,412, filed Mar. 31, 2004, now U.S. Pat. No. 7,009,564, which is a continuation-in-part of U.S. patent application Ser. No. 10/664,614, filed Sep. 19, 2003, U.S. Pat. No. 6,856,290.

BACKGROUND OF THE INVENTION

1. Field of the Invention

The present invention relates generally to a microstrip antenna for use on a weapons system to transmit telemetry data. More specifically, the present invention relates to a cylindrical shaped microstrip antenna array which operates in the X-band frequency of the electromagnetic spectrum and which is adapted for use on a 14-inch diameter weapons system such as a missile.

2. Description of the Prior Art

A microstrip antenna operates by resonating at a frequency. The conventional design uses printed circuit techniques to put a printed copper patch on the top of a layer of dielectric with a ground plane on the bottom of the dielectric. The frequency that the microstrip antenna operates at is approximately a half-wavelength in the microstrip medium of dielectric below the patch and air above the patch.

There is currently a need to produce a quasi omni-directional radiation pattern from a conformal wrap-around microstrip antenna with a 14-inch maximum diameter and 5-inch maximum length. The antenna is to be used on a weapons system or projectile such as a missile. The required frequency of operation for the antenna is 7900 to 8100 MHz telemetry frequency band which is the X-Band frequency range of the electromagnetic spectrum.

SUMMARY OF THE INVENTION

The present invention overcomes some of the disadvantages of the past including those mentioned above in that it comprises a highly effective and efficient microstrip antenna designed to transmit telemetry data from a missile/projectile at the X-Band frequency range of the electromagnetic spectrum. The X-Band microstrip antenna comprising the present invention is configured to wrap around the projectile's body without interfering with the aerodynamic design of the projectile.

The X-Band microstrip antenna is designed to transmit telemetry data and is adapted for use on a fourteen inch diameter projectile. The microstrip antenna operates at the 7900 to 8100 MHz X-Band frequency band. Sixteen copper plated microstrip antenna elements equally spaced around the projectile provide for linear polarization and a quasi-omni directional radiation pattern.

The X-Band microstrip antenna includes a feed network which consist of equal amplitude and phase power dividers. The feed network for the X-Band microstrip antenna drives the antenna elements with equal amplitude and equal phase.

DETAILED DESCRIPTION OF THE PREFERRED EMBODIMENT

Figure 1:
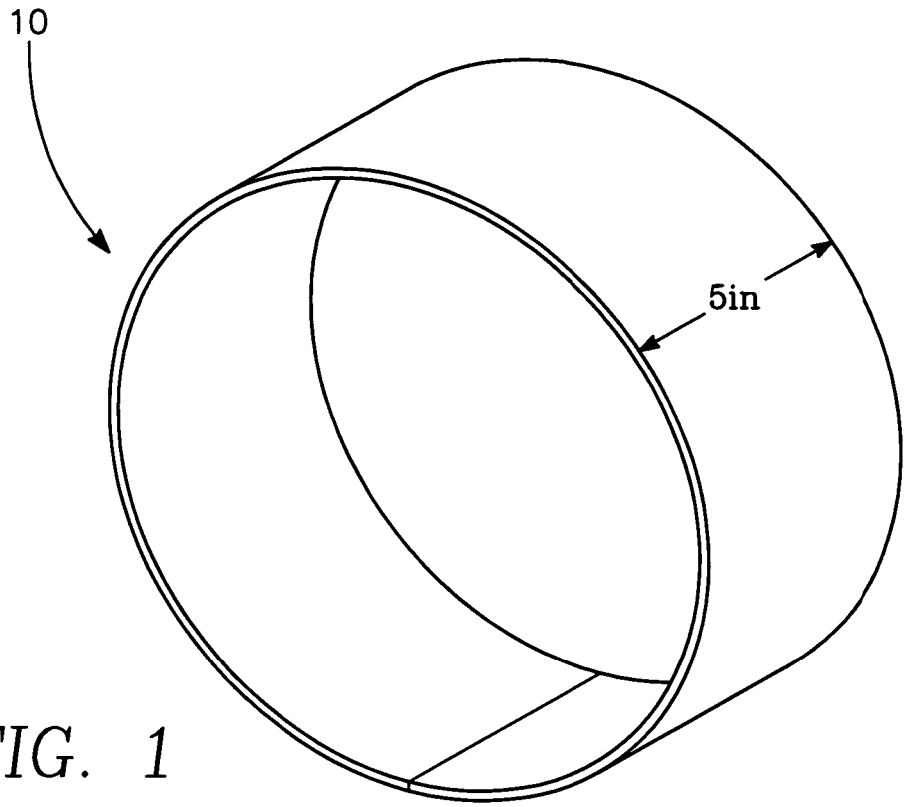
FIG. 1 is a perspective view of the fourteen inch X-Band microstrip antenna comprising the present invention.
Figure 2A:
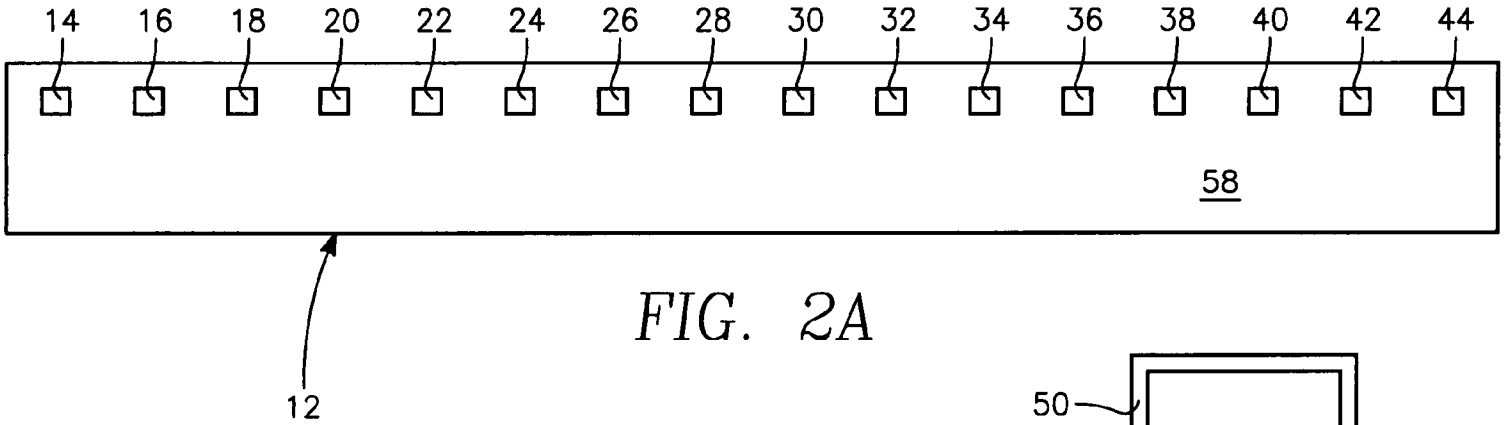
FIGS. 2A and 2B illustrate the top layer of the circuit printed circuit board including the radiating elements for the fourteen inch X-Band microstrip antenna of FIG. 1.
Figure 2B:
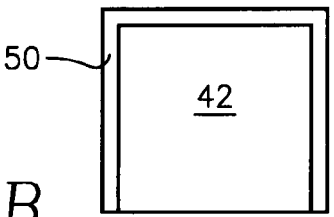

Referring to FIGS. 1, 2A and 2B, there is shown a X-Band microstrip antenna 10 which is a wrap around conformal antenna designed for a small projectile having a maximum diameter of fourteen inches. The maximum width W for antenna 10 is five inches. Antenna 10 operates at the X-Band frequency which is 7900 MHz to 8100 MHz.

Referring again to FIGS. 1, 2A, and 2B, the top layer of the circuit printed circuit board 12 for microstrip antenna 10 includes sixteen half-wavelength antenna elements 14, 16, 18, 20, 22, 24, 26, 28, 30, 32, 34, 36, 38, 40, 42 and 44. Equally dividing the circumference of microstrip antenna 10 into sixteen parts in the manner illustrated in FIG. 2A and placing a half-wavelength microstrip antenna element 14, 16, 18, 20, 22, 24, 26, 28, 30, 32, 34, 36, 38, 40, 42 and 44 in each part provides the required quasi-omni direction radiation pattern for antenna 10.

As shown in FIG. 2B, there is also a three sided gap 50 formed around the top and two sides of the sixteen antenna elements 14, 16, 18, 20, 22, 24, 26, 28, 30, 32, 34, 36, 38, 40, 42 and 44 of X-Band microstrip antenna 10. The three sided gap 50 exposes the top surface of the dielectric substrate for circuit board 12. The X-Band microstrip antenna's electric field is confined primarily to the three sided gap 50 around each of the antenna elements 14, 16, 18, 20, 22, 24, 26, 28, 30, 32, 34, 36, 38, 40, 42 and 44 which is substantial different than a conventional microstrip copper antenna element where the electric field extends well beyond the antenna element.

Figure 3:
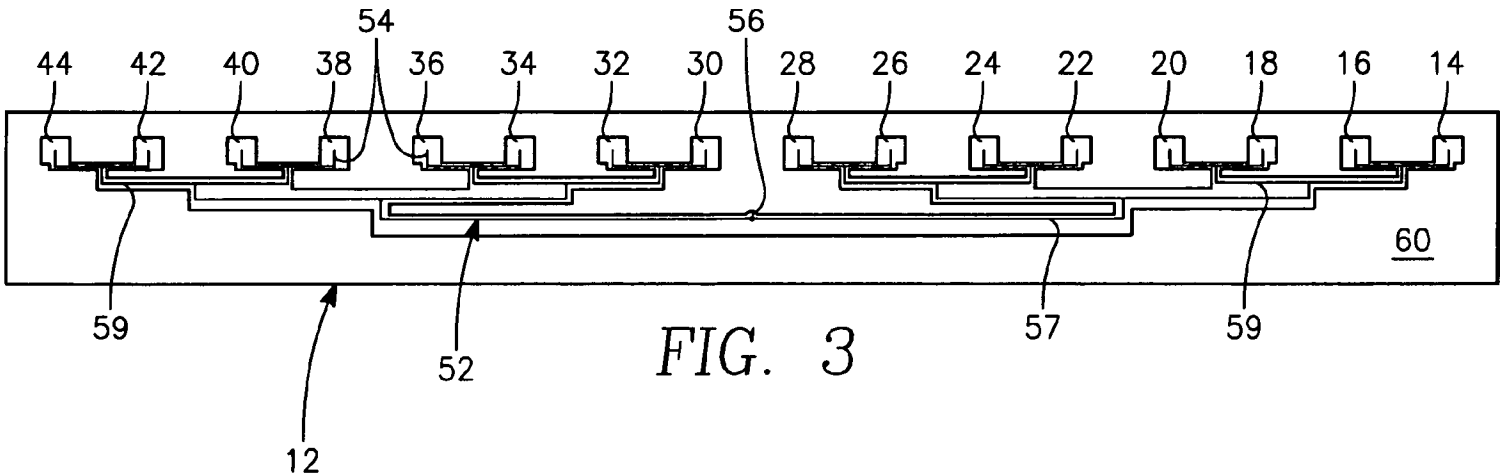
FIG. 3 is a top view illustrating the bottom layer of the circuit printed circuit board for the fourteen inch X-Band microstrip antenna of FIG. 1.

Referring to FIGS. 2A and 3, the feed network 52 for the antenna elements of X-Band microstrip antenna 10 is a located on the bottom layer of the circuit board 12 for the X-Band microstrip antenna 10. The signal input 54 for each of the antenna elements 14, 16, 18, 20, 22, 24, 26, 28, 30, 32, 34, 36, 38, 40, 42 and 44 is located at the center of each antenna element. The configuration of feed network 52, which includes a main transmission line 57 and a plurality of branch transmission lines 59, insures that the feed network 52 operates as an equal amplitude, equal phase power divider providing for equal distribution of RF signals with respect to the sixteen antenna elements 14, 16, 18, 20, 22, 24, 26, 28, 30, 32, 34, 36, 38, 42 and 44 in both amplitude and phase. The feed network 52 matches a 50 ohm input impedance to the feed networks signal input 56 to the missile's on board electronics and computer. The feed networks signal input 56 is centrally located on bottom layer of circuit board 12. The polarization of X-Band microstrip antenna 10 is linear polarization.

Figure 6:
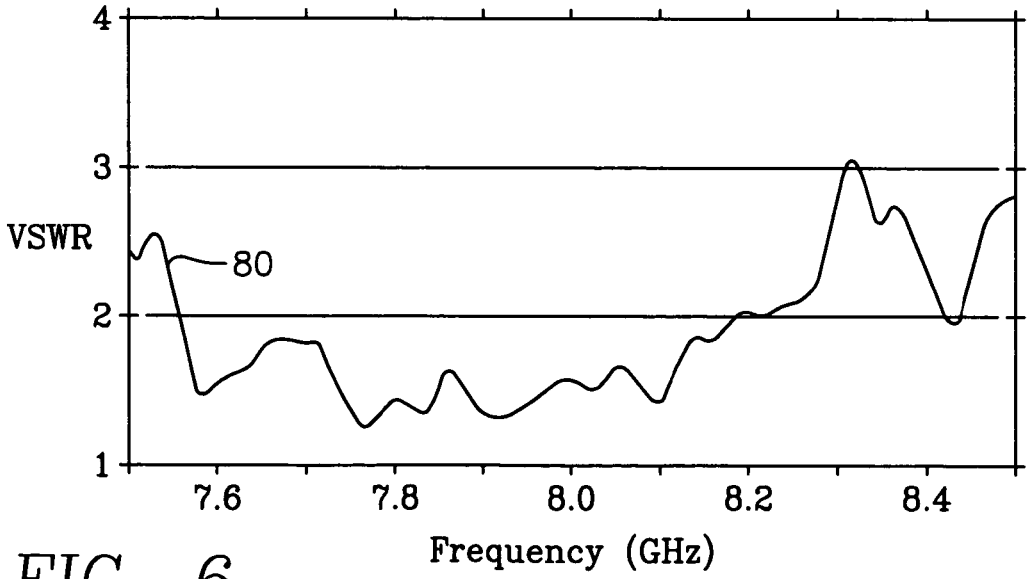
FIG. 6 is a plot which illustrates the Voltage Standing Wave Ratio (VSWR) as a function of Frequency for the fourteen inch X-Band microstrip antenna of FIG. 1.

Referring to FIG. 6, FIG. 6 is representative of a typical VSWR measurement (plot 80 of FIG. 6) for the X-Band microstrip antenna 10. Plot 80 shows a frequency bandwidth from 7.6 GHz to about 8.4 GHZ which greatly exceeds the 7900 to 8100 MHz requirement for antenna 10.

Copper plating (designated generally by reference numeral 58 in FIG. 2A and reference numeral 60 in FIG. 3) surrounds each of the antenna elements on the top layer of circuit board 12 and the feed network 52 on the bottom layer of circuit board 12 to reduce radiation from the feed network 52 and closely control the radiation pattern from the antenna elements.

Figure 4:
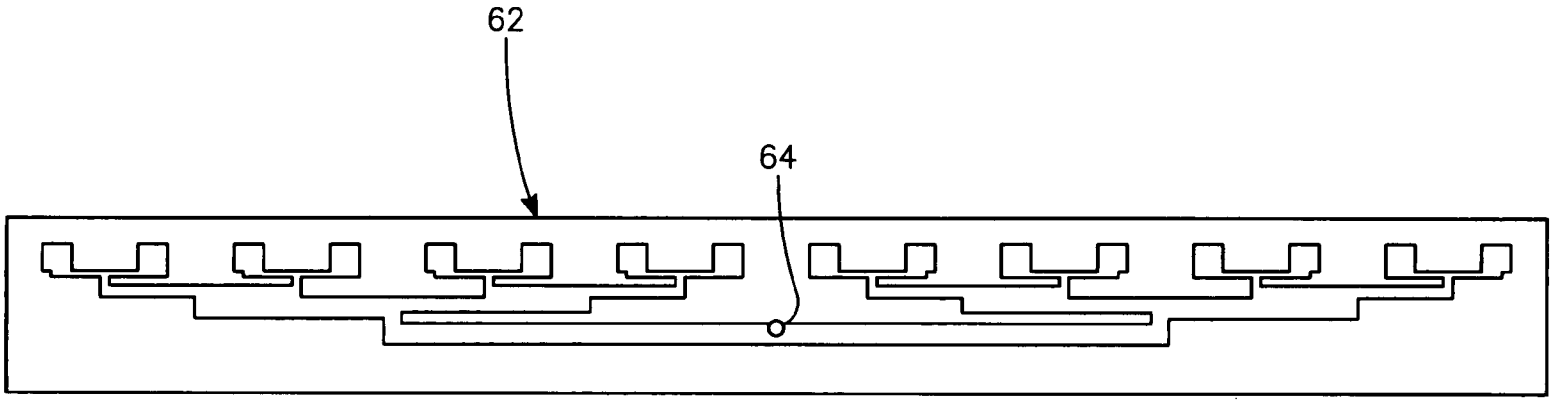
FIG. 4 is a view illustrating the top layer of the ground printed circuit board for the fourteen inch X-Band microstrip antenna of FIG. 1.

Referring to FIGS. 2, 3 and 4, X-Band antenna 10 includes three printed circuit boards arranged as a stack. The outside or cover board is a protective layer having the same dimensions as circuit board 12. The outside layer, which has a thickness of 0.062 inches, is fabricated from Rogers Corporation RT/5870 commercially available from Rogers Corporation of Rogers, Connecticut. The middle layer printed circuit board in the stack is circuit board 12 and the inside layer printed circuit board for antenna 10 is the ground printed circuit board 62 (FIGS. 3 and 4). Circuit board 12 and ground board 62 are each fabricated from Rogers Corporation Duroid RT/6002 which has a 0.600 inch thickness clad with one ounce copper. The dielectric material selected for boards 12 and 62 was used because of the dielectric materials extremely stable properties with large temperature variations. X-Band microstrip antenna 10 utilizes two dielectric layers, circuit board 12 and ground board 62, because a board thickness in the board in excess of 0.060 inches for this dielectric material will cause the material to crack when bent in the configuration required by antenna 10.

The top layer of the ground printed circuit board 62 is copper plating and is identical to the bottom layer of circuit board 12 except the feed network has been removed exposing the dielectric material of circuit board 62. The bottom layer of circuit board 12 is solid copper with a clearance hole 64 for the signal input to feed network 52 and antenna elements.

Figure 5:
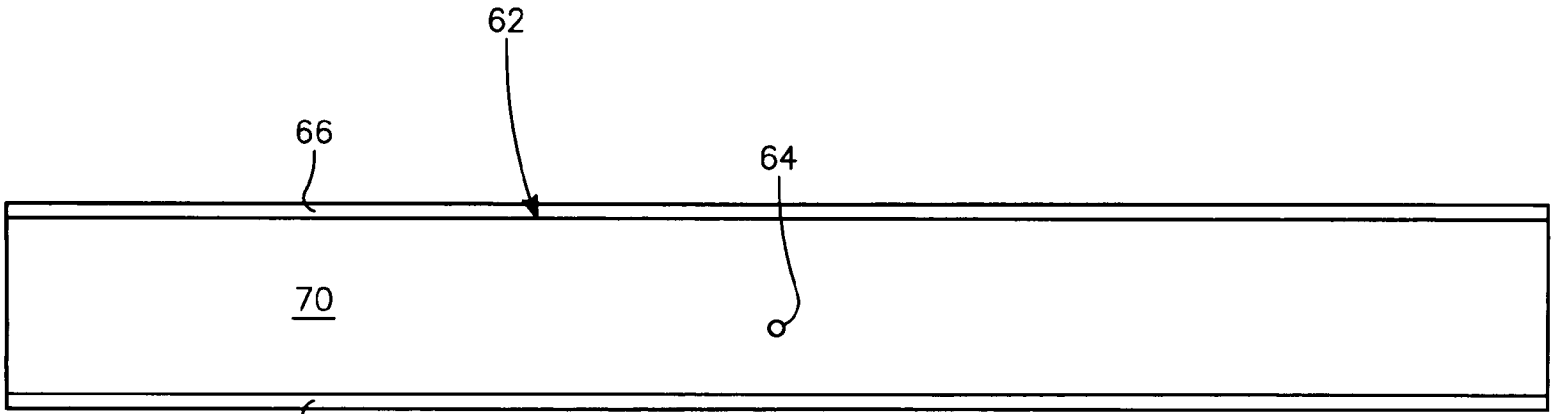
FIG. 5 is a top view illustrating the bottom layer of the ground printed circuit board for the fourteen inch X-Band microstrip antenna of FIG. 1.

As seen in FIG. 5, when the X-Band antenna 10 is assembled the upper portion 66 and the lower portion 68 of the ground board are removed. This leaves only the middle portion 70 of the ground board 62 when the antenna is fully assembled. The circuit board 12 and cover board also have their upper and lower portions removed when the antenna is fully assembled.

Each of the printed circuit boards of X-Band microstrip antenna 10 is gold plated to protect the printed circuit boards from environmental conditions and high bonding temperatures.

Referring to FIG. 6, FIG. 6 is representative of a typical VSWR measurement (plot 80 of FIG. 6) for the X-Band microstrip antenna 10. Plot 80 shows a frequency bandwidth from 7.6 GHz to about 8.4 GHZ which greatly exceeds the 7900 to 8100 MHz requirement for X-Band microstrip antenna 10.

From the foregoing, it is readily apparent that the present invention comprises a new, unique, and exceedingly useful X-Band microstrip antenna adapted for use on 14 inch diameter projectiles, which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. An X-band microstrip antenna mounted on a projectile comprising:

(a) a first rectangular shaped dielectric layer;

(b) sixteen rectangular shaped antenna elements mounted on an upper surface of said first dielectric layer, said antenna elements being aligned with one another, equally spaced apart from one another and fabricated from copper, said antenna elements being adapted to transmit telemetry data within an X-Band frequency range of 7900 to 8100 MHz;

(c) an antenna feed network mounted on a bottom surface of said first dielectric layer, said antenna feed network having a main transmission line connected to a signal input for said X-band microstrip antenna, and a plurality of branch transmission lines extending from said main transmission line and connected to each of said sixteen antenna elements, said antenna feed network being configured to drive said sixteen antenna elements with equal phase and equal amplitude signals resulting in a linear polarization and an omni-directional radiation pattern being generated by said sixteen antenna elements of said X-band microstrip antenna;

(d) a second dielectric layer positioned below said first dielectric layer in alignment with said first dielectric layer, said second dielectric layer having a solid copper ground plane affixed to a bottom surface of said second dielectric layer; and (e) said X-band microstrip antenna having a Voltage Standing Wave Ratio of less than 2:1 over a frequency range of 7.6 GHz to 8.2 GHz.

2. The X-band microstrip antenna of claim 1 wherein the signal input for said X-band microstrip antenna matches a 50 ohm input impedance to the signal input for said X-band microstrip antenna.

3. The X-band microstrip antenna of claim 1 wherein said first dielectric layer and said second dielectric layer are gold plated to protect said first dielectric layer and said second dielectric layer from environmental conditions and high bonding temperatures.

4. The X-band microstrip antenna of claim 1 wherein said X-band microstrip antenna has a diameter of fourteen inches and a width of five inches when mounted on said projectile.

5. The X-band microstrip antenna of claim 1 further comprising a third dielectric layer positioned above said first dielectric layer in alignment with said first dielectric layer, said third dielectric layer functioning as a protective layer for said X-band microstrip antenna wherein said third dielectric layer is gold plated to protect said first dielectric layer and said second dielectric layer from environmental conditions and high bonding temperatures.

6. The X-band microstrip antenna of claim 1 wherein said first dielectric layer and said second dielectric layer each have a 0.060-inch thickness clad with one-ounce copper to prevent cracking of said first dielectric layer and said second dielectric layer when said first dielectric layer and said second dielectric layer are mounted on said projectile.

7. An X-band microstrip antenna mounted on a projectile comprising:

(a) a first rectangular shaped dielectric layer;

(b) sixteen rectangular shaped antenna elements mounted on an upper surface of said first dielectric layer, said antenna elements being aligned with one another, equally spaced apart from one another and fabricated from copper, said antenna elements being adapted to transmit telemetry data within an X-Band frequency range of 7900 to 8100 MHz;

(c) a continuous gap formed around three sides of each of said sixteen antenna elements, said continuous gap for each of said sixteen antenna elements having an electric field generated by each of said sixteen antenna element confined to said continuous gap;

(d) an antenna feed network mounted on a bottom surface of said first dielectric layer, said antenna feed network having a main transmission line connected to a signal input for said X-band microstrip antenna, and a plurality of branch transmission lines extending from said main transmission line wherein one branch line of said plurality of branch transmission lines is connected to each of said sixteen antenna elements;

(e) a second dielectric layer positioned below said first dielectric layer in alignment with said first dielectric layer, said second dielectric layer having a solid copper ground plane affixed to a bottom surface of said second dielectric layer; and (f) said X-band microstrip antenna having a Voltage Standing Wave Ratio of less than 2:1 over a frequency range of 7.6 GHz to 8.2 GHz.

8. The X-band microstrip antenna of claim 7 wherein said antenna feed network is configured to drive said sixteen antenna elements with equal phase and equal amplitude signals resulting in a linear polarization and an omni-directional radiation pattern being generated by said sixteen antenna elements of said X-band microstrip antenna.

9. The X-band microstrip antenna of claim 7 further comprising copper plating mounted on a remaining portion of the upper surface of said first dielectric layer wherein said copper plating surrounds the continuous gap for each of said sixteen antenna elements.

10. The X-band microstrip antenna of claim 7 further comprising copper plating mounted on a remaining portion of the lower surface of said first dielectric layer wherein said copper plating surrounds the feed network for the sixteen antenna elements of said X-band microstrip antenna.

11. The X-band microstrip antenna of claim 7 wherein the signal input for said X-band microstrip antenna matches a 50 ohm input impedance to the signal input for said X-band microstrip antenna.

12. The X-band microstrip antenna of claim 7 wherein said first dielectric layer and said second dielectric layer are gold plated to protect said first dielectric layer and said second dielectric layer from environmental conditions and high bonding temperatures.

13. An X-band microstrip antenna mounted on a projectile comprising:

(a) a first rectangular shaped dielectric layer;

(b) sixteen rectangular shaped antenna elements mounted on an upper surface of said first dielectric layer, said antenna elements being aligned with one another, equally spaced apart from one another and fabricated from copper, said antenna elements being adapted to transmit telemetry data within an X-Band frequency range of 7900 to 8100 MHz;

(c) a continuous gap formed around three sides of each of said sixteen antenna elements, said continuous gap for each of said sixteen antenna elements having an electric field generated by each of said sixteen antenna element confined to said continuous gap;

(d) an antenna feed network mounted on a bottom surface of said first dielectric layer, said antenna feed network having a main transmission line connected to a signal input for said X-band microstrip antenna, and a plurality of branch transmission lines extending from said main transmission line wherein one branch line of said plurality of branch transmission lines is connected to each of said sixteen antenna elements, wherein said antenna feed network is configured to drive said sixteen antenna elements with equal phase and equal amplitude signals resulting in a linear polarization and an omni-directional radiation pattern being generated by said sixteen antenna elements of said X-band microstrip antenna;

(e) said first dielectric layer having copper plating mounted on a remaining portion of the upper surface and the lower surface of said first dielectric layer wherein said copper plating on the upper surface of said first dielectric layer surrounds the continuous gap for each of said sixteen antenna elements and the copper plating on the lower surface of said first dielectric layer surrounds said antenna feed network, wherein said copper plating on the upper surface and lower surface of said dielectric layer reduces radiation from said antenna feed network and controls a radiation pattern from said sixteen antenna elements;

(f) a second dielectric layer positioned below said first dielectric layer in alignment with said first dielectric layer, said second dielectric layer having a solid copper ground plane affixed to a bottom surface of said second dielectric layer; and (g) said X-band microstrip antenna having a Voltage Standing Wave Ratio of less than 2:1 over a frequency range of 7.6 GHz to 7.2 GHz.

14. The X-band microstrip antenna of claim 13 wherein the signal input for said X-band microstrip antenna matches a 50 ohm input impedance to the signal input for said X-band microstrip antenna.

15. The X-band microstrip antenna of claim 13 wherein said first dielectric layer and said second dielectric layer are gold plated to protect said first dielectric layer and said second dielectric layer from environmental conditions and high bonding temperatures.

16. The X-band microstrip antenna of claim 13 further comprising a third dielectric layer positioned above said first dielectric layer in alignment with said first dielectric layer, said third dielectric layer functioning as a protective layer for said X-band microstrip antenna wherein said third dielectric layer is gold plated to protect said first dielectric layer and said second dielectric layer from environmental conditions and high bonding temperatures.

17. The X-band microstrip antenna of claim 13 wherein a top layer of said second dielectric layer has copper plating and is identical to the bottom layer of said first dielectric layer with said antenna feed network being removed from the top layer of said second dielectric layer.

* * * * *